United States Patent [19]

Hora et al.

[11] 4,261,868

[45] Apr. 14, 1981

[54] STABILIZED ENZYMATIC LIQUID DETERGENT COMPOSITION CONTAINING A POLYALKANOLAMINE AND A BORON COMPOUND

[75] Inventors: Jiri Hora, Vierpolders; Gerardus A. A. Kivits, Hellevoetaluis, both of Netherlands

[73] Assignee: Lever Brothers Company, New York, N.Y.

[21] Appl. No.: 64,666

[22] Filed: Aug. 8, 1979

Related U.S. Application Data

[63] Continuation of Ser. No. 923,847, Jul. 12, 1978, abandoned, which is a continuation of Ser. No. 846,087, Oct. 27, 1977, abandoned.

[51] Int. Cl.[3] ..... C11D 3/386

[52] U.S. Cl. ..... 252/529; 252/174.12; 252/174.17; 435/188; 435/264

[58] Field of Search ..... 252/DIG. 12, 529, 548, 252/174.12; 435/188, 264

[56] References Cited

U.S. PATENT DOCUMENTS

| | | | |
|---|---|---|---|
| 2,917,433 | 12/1959 | Goldman | 424/94 |
| 3,600,318 | 8/1971 | Mast | 252/DIG. 12 X |
| 3,725,289 | 4/1973 | Mouret | 252/DIG. 12 X |
| 3,761,420 | 9/1973 | Bogardus | 252/DIG. 12 X |
| 3,893,954 | 7/1975 | Tivin et al. | 252/DIG. 12 X |
| 4,021,377 | 5/1977 | Borchert et al. | 252/DIG. 12 X |
| 4,142,999 | 3/1979 | Bloching et al. | 252/544 |

FOREIGN PATENT DOCUMENTS

| | | |
|---|---|---|
| 41-1019266 | 5/1966 | Japan . |
| 1224564 | 3/1971 | United Kingdom . |

*Primary Examiner*—Harris A. Pitlick

*Attorney, Agent, or Firm*—Michael J. Kelly; James J. Farrell; Melvin H. Kurtz

[57] ABSTRACT

The storage stability of aqueous enzymatic liquid detergent compositions is improved by the inclusion therein of a stabilizing system comprising a poly-functional amino compound such as triethanolamine and boric acid or a boron-equivalent thereof.

5 Claims, No Drawings

STABILIZED ENZYMATIC LIQUID DETERGENT COMPOSITION CONTAINING A POLYALKANOLAMINE AND A BORON COMPOUND

This application is a continuation of Ser. No. 923,847, filed July 12, 1978, now abandoned, which in turn is a continuation of Ser. No. 846,087, filed Oct. 27, 1977 also abandoned.

BACKGROUND OF THE INVENTION

1. Field of the Invention

The present invention relates to an enzymatic liquid composition and more particularly to an enzymatic liquid detergent composition with an improved storage stability.

2. Description of the Prior Art

Liquid detergent compositions are well known in the art and, after the revival of interest in enzymes for inclusion in detergent compositions, several proposals have been made in the art for enzymatic liquid detergent compositions.

Despite these proposals, such enzymatic liquid detergent compositions have not been put on the market to any significant extent, primarily because of severe instability problems incurred with the incorporation of enzymes in liquid detergent compositions. This problem is well recognized in the art, and it has for instance been proposed to reduce the instability of enzymes in liquid detergent compositions by incorporating stabilizing systems in such compositions. Such proposals include the use of polyols like glycerol, sorbitol; furthermore Ca-salts, alkoxy-alcohols, dialkylglycolethers, and mixtures of polyvalent alcohols with polyfunctional aliphatic amines. These systems are, however, primarily intended for inclusion in enzymatic liquid compositions with a pH value ranging from relatively acid to slightly alkaline.

SUMMARY OF THE INVENTION

It has now been found that the storage stability of aqueous enzymatic liquid compositions can be significantly improved by the inclusion therein of an effective amount of a stabilizing system comprizing a polyfunctional amino compound and boric acid or a boron-equivalent thereof as hereinafter more specifically defined.

DESCRIPTION OF THE PREFERRED EMBODIMENTS

The polyfunctional amino compounds of the invention are aliphatic organic compounds comprising at least one amine grouping and at least two hydroxyl groups. It is to be understood that quaternary ammonium compounds are not included in the term "polyfunctional amino compounds".

Typical examples of the polyfunctional amino compounds of the invention are polyalkanolamines such as diethanolamine, triethanolamine, di-isopropanolamine, tri-isopropanolamine, furthermore tris(hydroxymethyl) aminomethane.

The amount of the polyfunctional amino compound used is generally from 2-25, preferably from 4–15% by weight of the composition. Triethanolamine is the preferred polyfunctional amino compound in protease-containing liquids.

The boric acid or boron-equivalent thereof (a boron compound capable of reacting with the polyfunctional amino compound, such as boric oxide, borax and other alkali metal borates such as sodium ortho, meta- and pyroborate) is used in an amount of generally 0.25 to 15, preferably 0.5–10% by weight of the composition, the boron equivalent being calculated on the basis of boric acid. Preferably the amount is such that the weight ratio of the polyfunctional amino compound to the boric acid or boron-equivalent (calculated on the basis of the boric acid) thereof varies from 10:1 to 1:2, preferably 7:1 to 2:1.

The stabilizing system, comprising the polyfunctional amino compound and the boric acid or boron-equivalent thereof, may be incorporated in the liquid enzyme system either by adding the constituents as such to the liquid, or by adding the separately prepared stabilizing system, e.g. as the polyfunctional amino compound/boric acid or boron-equivalent reaction product. Mixtures of various poly-functional amino compounds may also be used, as well as mixtures of a polyfunctional amino compound with a polyhydroxy compound not containing an amino grouping, e.g. erythritan. It has furthermore been found that the inclusion of up to 10% by weight of saccharose further enhances the storage stability.

The enzymes to be incorporated can be proteolytic, amylolytic and cellulolytic enzymes as well as mixtures thereof. They may be of any suitable origin, such as vegetable, animal, bacterial, fungal and yeast origin. However, their choice is governed by several factors such as pH-activity and/or stability optima, thermostability, stability versus active detergents, builders and so on. In this respect bacterial or fungal enzymes are preferred, such as bacterial amylases and proteases, and fungal cellulases. The present invention is of particular benefit for enzymatic liquid detergents having a pH of above 7.5, particularly those incorporating bacterial proteases of which the pH-optima lie in the range between 8.5–10.5, but it is to be understood that enzymes with a somewhat lower or higher pH-optimum can still be used in the composition of the invention, benefiting from it.

Suitable examples of such proteases are the subtilisins which are obtained from particular strains of B.subtilis and B. licheniformis, such as the commerically available subtilisins Maxatase® (ex Gist-Brocades N.V., Delft, Holland) and Alcalase® (ex Novo Industri A/S, Copenhagen, Denmark).

As stated above, the present invention is of particular benefit for enzymatic liquid detergents incorporating enzymes with pH activity and/or stability optima of above 8.5, such enzymes also being commonly called high-alkaline enzymes.

Particularly suitable is a protease obtained from a strain of Bacillus, having maximum activity throughout the pH range of 8–12, developed and sold by Novo Industri A/S under the registered trade name Esperase®. The preparation of this enzyme and analogous enzymes is described in British patent specification No. 1,243,784 of Novo.

High alkaline amylases and cellulases can also be used, e.g. α-amylases obtained from a special strain of B. licheniformis, described in more detail in British patent specification No. 1,296,839 (Novo).

The amount of enzymes present in the liquid composition may vary from 0.001 to 10% by weight, and preferably from 0.01 to 5% by weight. This amount is of course highly dependent upon the activity of the enzyme used.

When the liquid compositions of the invention are detergent compositions, these liquid detergent compositions comprise as a further essential ingredient an active detergent material, which may be an anionic, nonionic, cationic, zwitterionic or amphoteric detergent material.

Examples of anionic synthetic detergents are salts (including sodium, potassium, ammonium, and substituted ammonium salts such as mono-, di- and triethanolamine salts) of $C_9$–$C_{20}$ alkylbenzenesulphonates, $C_8$–$C_{22}$ primary or secondary alkanesulphonates, $C_8$–$C_{24}$ olefinsulphonates, sulphonated polycarboxylic acids, prepared by sulphonation of the pyrolyzed product of alkaline earth metal citrates, e.g. as described in British patent specification No. 1,082,179, $C_8$–$C_{22}$ alkylsulphates, $C_8$–$C_{24}$ alkylpolyglycolethersulphates (containing up to 10 moles of ethylene oxide); further examples are described in "Surface Active Agents and Detergents" (Vol. I and II by Schwartz, Perry and Berch).

Examples of nonionic synthetic detergents are the condensation products of ethylene oxide, propylene oxide and/or butylene oxide with $C_8$–$C_{18}$ alkylphenols, $C_8$–$C_{18}$ primary or secondary aliphatic alcohols, $C_8$–$C_{18}$ fatty acid amides; further examples of nonionics include tertiary amine oxides with one $C_8$–$C_{18}$ alkyl chain and two $C_{1-3}$ alkyl chains. The above reference also describes further examples of nonionics.

The average number of moles of ethylene oxide and/or propylene oxide present in the above nonionics varies from 1–30; mixtures of various nonionics, including mixtures of nonionics with a lower and a higher degree of alkoxylation, may also be used.

Examples of cationic detergents are the quaternary ammonium compounds such as alkyldimethylammonium halogenides, but such cationics are less preferred for inclusion in enzymatic detergent compositions.

Examples of amphoteric or zwitterionic detergents are N-alkylamino acids, sulphobetaines, condensation products of fatty acids with protein hydrolysates, but owing to their relatively high costs they are usually used in combination with an anionic or a nonionic detergent. Mixtures of the various types of active detergents may also be used, and preference is given to mixtures of an anionic and a nonionic detergent active. Soaps (in the form of their sodium, potassium, and substituted ammonium salts such as triethanolamine salts) of $C_8$—$C_{22}$ fatty acids, as well as of polymerized fatty acids, may also be used and may exert a beneficial influence on the foaming behaviour of the final composition.

The amount of the active detergent material varies from 10 to 60%; when mixtures of e.g. anionics and nonionics are used the relative weight ratio varies from 1:1 to 1:10. When a soap is also incorporated, the amount thereof is from 1–40% by weight.

Although the liquids may contain up to 40% of a suitable builder, such as sodium, potassium and ammonium or substituted ammonium pyro-, and tripolyphosphates, nitrilotriacetates, etherpolycarboxylates, citrates, carbonates, orthophosphates, polyelectrolytes such as polyvinylmethylether/maleic anhydride copolymers and so on, the present invention is of particular benefit for use in unbuilt liquid detergents.

The amount of water present in the compositions of the invention varies from 5 to 70% by weight.

Other conventional materials may also be present in the liquid detergent compositions of the invention, for example soil-suspending agents, hydrotropes, corrosion inhibitors, dyes, perfumes, silicates, optical brighteners, suds boosters, suds depressants, germicides, anti-tarnishing agents, opacifiers, fabric softening agents, oxygen-liberating bleaches such as sodium perborate or percarbonate with or without bleach precursors, buffers and the like.

The pH of the final composition preferably lies within the range of 7.5 to 11.0, and is, if necessary, adjusted to a value within that range by addition of a suitable acid or alkaline material.

The invention will now be further illustrated by way of Example. In the Examples the percentages are by weight. The enzyme half-life time extension factor was determined in the following way:

A continuously withdrawn sample from a solution to be tested was continuously diluted (1:200) and continuously assayed on enzymatic activity (for proteolytic activity casein was used as a substrate). The logarithms of residual activity were plotted against the time, and the first order rate constant $K_1$ was computed.

The enzyme half-life time extension factor ($F_t$) is defined as $$F_t = \frac{K_1 \text{ (without stabilizing system)}}{K_1 \text{ (with stabilizing system)}} = \frac{t_{y/2} \text{ (with stabilizing system)}}{t_{y/2} \text{ (without stabilizing system)}}$$

EXAMPLE I

Tests were carried out with a bacterial subtilisin-type protease, Alcalase® ex Novo, (activity 10.6 Au/g) in the following aqueous system comprising:

0.2 M pentasodiumtripolyphosphate
0.12 M dimethylglycine
1.7 g Alcalase®

The pH of this system was 10.0, and the temperature 57° C. The rate of loss of enzyme activity in this system with and without the stabilizing system was measured and the enzyme half-life extension factor $F_t$) was determined. The following results were obtained:

| No. | Additive (in % by weight) | Ft value |
|---|---|---|
| 1 | 6% tris(hydroxymethyl)aminomethane + 6.2% borax | 7.5 |
| 2 | 6% tris(hydroxymethyl)aminomethane + 9.4% borax | 13.7 |
| 3 | 10% tris(hydroxymethyl)aminomethane + 15.7% borax | 23.5 |
| 4 | 5% tris(hydroxymethyl)aminomethane + 5% erythritan + 12.4% borax | 18.6 |
| 5 | 10% triisopropanolamine + 8.4% borax | 12.7 |
| 6 | triethanolamineorthoborate (prepared from 10% triethanolamine and 12.8% borax) | 5.2 |

-continued

| No. | Additive (in % by weight) | Ft value |
|---|---|---|
| 7 | 6% diethanolamine + 5.4% borax | 2.5 |

EXAMPLE II

In a manner analogous to that of Example I, tests were carried out with a bacterial protease, Esperase® (activity 41.5 KNPU/g) in the same system, but at 60° C.

A control-composition with 8.8% borax alone gave a $F_t$-value of 0.7; with 2.5, 7.5 or 12.5 triethanolamine alone $F_t$-values of 1.0, 1.1 and 1.0 were obtained.

With systems according to the invention the following results were obtained:

| No. | Additive (% by weight) | Ft-value |
|---|---|---|
| 8 | 12% triethanolamineorthoborate | 5.9 |
| 9 | 12% triethanolamineorthoborate (prepared in situ with $H_3BO_3$) | 4.8 |
| 10 | 10% triethanolamineorthoborate | 4.3 |
| 11 | 8% triethanolamineorthoborate | 3.0 |
| 12 | 6% triethanolamineorthoborate | 2.1 |
| 13 | 4% triethanolamineorthoborate | 2.0 |
| 14 | 2% triethanolamineorthoborate | 1.6 |
| 15 | 8% triethanolamine + 5.6% borax | 2.6 |
| 16 | 8% triethanolamine + 6.8% borax | 3.4 |
| 17 | 8% triethanolamine + 8.6% borax | 3.4 |
| 18 | 8% triethanolamine + 10.2% borax | 3.2 |
| 19 | 6% diethanolamine + 5.4% borax | 3.2 |

-continued

| No. | Additive (% by weight) | Ft-value |
|---|---|---|
| 20 | 8% tris(hydroxymethyl)aminomethane + 7.7% borax | 1.7 |

EXAMPLE III

Tests were carried out in a manner analogous to that of Example I with a bacterial amylase (Thermamyl® ex Novo) in an aqueous system comprising:

0.12 M. pentasodium-tripolyphosphate
0.1 M. glycine
0.5 g Thermamyl (activity 450 KNU/g)

The pH was 9.95, and the temperature was 59.3° C. The following results were obtained:

| No. | Additive (% by weight) | Ft value |
|---|---|---|
| 21 | 2% tris(hydroxymethylamino)methane + 3.15% borax | 1.4 |
| 22 | 6% tris(hydroxymethylamino)methane + 9.45% borax | 2.4 |
| 23 | 10% tris(hydroxymethylamino)methane + 15.75% borax | 4.6 |
| 24 | 6.28% triethanolamineorthoborate | 1.4 |

EXAMPLE IV

The following aqueous enzymatic liquid detergent compositions were prepared by adding 0.5% of an enzyme slurry (Maxatase® 500,000, a bacterial subtilisin-type protease ex Gist-Brocades, Delft, Holland, having an activity of 500,000 Delft Units/gr) to the tabulated formulations, and their storage stability at 37° C. was determined.

| | Nr. A | B | C | D |
|---|---|---|---|---|
| | % by weight | | | |
| linear $C_{16}$-$C_{18}$ alcohol, condensed with 18 moles of ethylene oxide | 21 | 21 | 21 | 21 |
| linear $C_9$-$C_{11}$ alcohol condensed with 8 moles of ethylene oxide | 7 | 7 | 7 | 7 |
| sodium xylene sulphonate | 3 | 3 | 3 | 3 |
| dimerized oleic acid | 6.5 | 6.5 | 6.5 | 6.5 |
| triethanolamine | 10 | 10 | 10 | 10 |
| lauryl alcohol, condensed with 2 moles of ethylene oxide | 7 | 7 | 7 | 7 |
| monoethylether of diethylene glycol | 10 | 10 | 10 | 10 |
| water | 30.5 | 25.5 | 20.5 | 15.5 |
| stabilizing system, comprising boric acid and triethanolamine in a weight ratio of 2:3, separately prepared | 5 | 10 | 15 | 20 |
| pH | 9 | 9 | 9 | 9 |
| The half-life time of the enzymatic activity was obtained after: | 6½ weeks | 8½ weeks | after 11 weeks still above 50% residual act. | after 11 weeks still above 50% residual activity |
| The residual enzymatic activity after 11 weeks' | | | | |

-continued

| | Nr. A | B | C | D |
|---|---|---|---|---|
| | % by weight | | | |
| storage was: | 32% | 35% | 60% | 70% |

EXAMPLE V

Repeating Example IV, but using 0.5% of a bacterial protease Esperase® ex Novo (act. 9 KNPU) instead of Alcalase, the liquids having a pH of 9.0 gave the following results: after 9 weeks of storage the products A-D still had a residual proteolytic activity well above 50% of the initial activity. These residual activities were 60%, 60% and 85% respectively.

EXAMPLE VI

Example V was repeated, but the storage test was now carried out at 50° C. Products A, B, and C reached the half-life enzyme activity level after 3½, 4 and 10 weeks' storage respectively. Product D had a residual enzyme activity of 88% after 7 weeks.

EXAMPLE VII

Aqueous systems containing Esperase® (20,000 G.U./ml) were stored at 37° C. The half-life time was assessed in days, using systems with additives as given below. The results are shown in the table.

| | pH* | half-life time in days |
|---|---|---|
| + 24.8 g/l boric acid | 10.5 | 6 |
| + 24.8 g/l boric acid + 10% saccharose | 10.5 | 8 |
| + 24.8 g/l boric acid + 5% triethanol amine | 10.5 | 9 |
| 10% saccharose + 5% triethanol amine | 10.2 | 6 |
| 24.8 g/l boric acid + 5% triethanol amine + 10% saccharose | 10.5 | 20 |

*pH adjusted with NaOH

We claim:

1. An aqueous enzymatic liquid detergent composition with improved storage stability, said composition having a pH of 7.5–11.0 and comprising a stabilizing system comprising (a) about 2 to about 25% by weight of the final composition of a polyfunctional amino compound selected from the group consisting of diethanolamine, triethanolamine, di-isopropanolamine, tri-isopropanolamine and tris(hydroxymethyl) aminomethane;

(b) about 0.25 to about 15% calculated on the basis of boric acid by weight of the final composition of a boron compound selected from the group consisting of boric acid, boric oxide, borax, sodium ortho-, meta- and pyroborate.

2. A composition according to claim 1, comprising about 4 to about 15% by weight of said polyfunctional amino compound and about 0.5 to about 10% by weight of said boron compound.

3. A composition according to claim 1, further comprising saccharose in an amount of up to about 10% by weight.

4. A composition according to claim 1, comprising about 0.001 to about 10% by weight of proteases, amylases or cellulases, about 10 to about 60% by weight of an active detergent material and about 5 to about 70% by weight of water.

5. A composition according to claim 4, having a pH of 8.5 to about 10.5.

* * * * *